United States Patent [19]

Kojima

[11] Patent Number: 4,615,684

[45] Date of Patent: Oct. 7, 1986

[54] DEVICE FOR PRECLUDING ELECTROLYTIC CORROSION OF A MARINE PROPULSION APPARATUS

[75] Inventor: Akinori Kojima, Hamamatsu, Japan

[73] Assignee: Sanshin Kogyo Kabushiki Kaisha, Hamamatsu, Japan

[21] Appl. No.: 633,144

[22] Filed: Jul. 23, 1984

[30] Foreign Application Priority Data

Jul. 28, 1983 [JP] Japan ..... 58-136882

[51] Int. Cl.[4] ..... B63H 21/10

[52] U.S. Cl. ..... 440/88; 204/147

[58] Field of Search ..... 440/49, 88, 113; 204/147, 148, 196, 197; 123/41.15, 41.14

[56] References Cited

U.S. PATENT DOCUMENTS

| | | | |
|---|---|---|---|
| 2,857,892 | 10/1958 | Hulsebus | 123/41.14 |
| 3,406,110 | 10/1968 | Turnes et al. | 204/148 |
| 3,558,463 | 1/1971 | Strobach et al. | 204/197 |
| 3,868,313 | 2/1975 | Gay | 204/147 |
| 4,486,181 | 12/1984 | Cavil | 440/49 |

*Primary Examiner*—Trygve M. Blix
*Assistant Examiner*—Jesûs D. Sotelo
*Attorney, Agent, or Firm*—Ernest A. Beutler

[57] ABSTRACT

An outboard motor having a liquid cooled internal combustion engine with an improved sacrificial anode for protecting the cooling system of the engine from electrochemical corrosion. The sacrificial anode is mounted in such a way that it may be conveniently removed for inspection or servicing without removal of any other component of the engine.

6 Claims, 3 Drawing Figures

DEVICE FOR PRECLUDING ELECTROLYTIC CORROSION OF A MARINE PROPULSION APPARATUS

BACKGROUND OF THE INVENTION

This invention relates to a device for precluding electrolytic corrosion of a marine propulsion apparatus and more particularly to an improved, serviceable sacrificial anode for such an application.

As is well known, outboard motors or marine propulsion drives are subject to electrolytic corrosion. The problem can be particularly acute if the engine is operated in a marine environment. In order to protect the internal components of the engine from electrolytic corrosion, it has been the practice to fit the engine cooling jacket with a sacrificial anode. Sacrificial anodes of the type heretofore employed, however, have generally been disposed in the cooling jacket of the cylinder block and held in place by the cylinder head. Thus, in order to check the condition of the sacrificial anode or replace it, it is necessary to remove the cylinder head. Removal of the cylinder head is obviously a time consuming project and also normally requires replacement of the cylinder head gasket each time the cylinder head is removed.

It is, therefore, a principal object of this invention to provide an improved sacrificial anode construction for a marine propulsion device.

It is another object of the invention to provide a readily replaceable sacrificial anode for a marine engine.

It is yet a further object of this invention to provide a removable sacrificial anode construction for an engine in which the anode can be conveniently replaced without necessitating the removal of other components of the engine.

SUMMARY OF THE INVENTION

This invention is adapted to be embodied in a cooling system for the internal combustion engine of a marine propulsion unit or the like having a working chamber. A cooling jacket encircles at least in part the working chamber. In accordance with the invention, the engine has a component that defines an external opening communicating with the cooling jacket. A scrificial anode is provided that has a first part which is supported in the opening and a second part that extends at least in part into the cooling jacket. Closure means are provided for forming a sealed closure for the opening.

DETAILED DESCRIPTION OF THE PREFERRED EMBODIMENT

Figure 1:
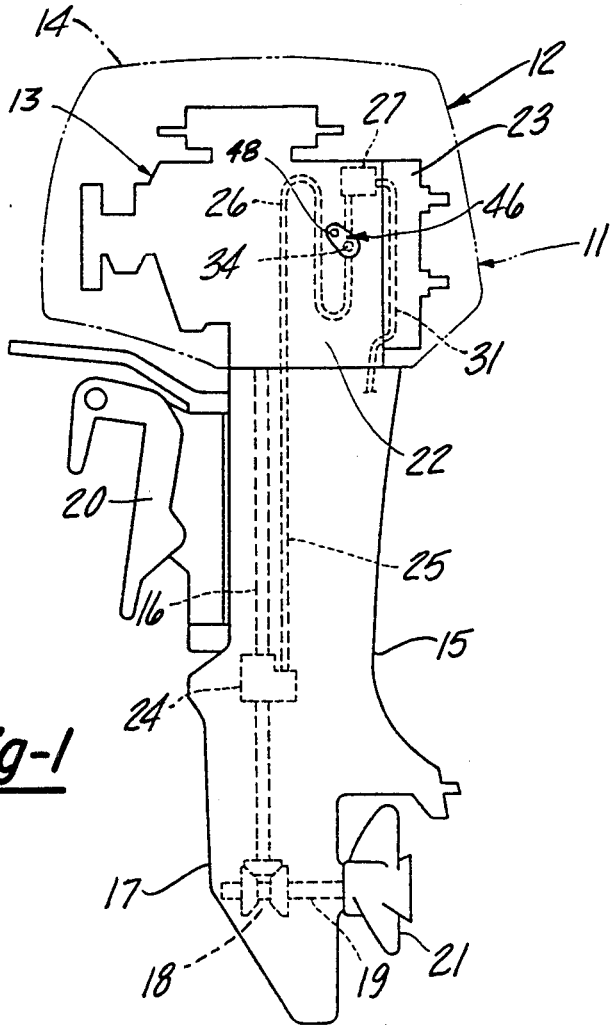
FIG. 1 is a side elevational view of an outboard motor constructed in accordance with an embodiment of the invention.
Figure 3:
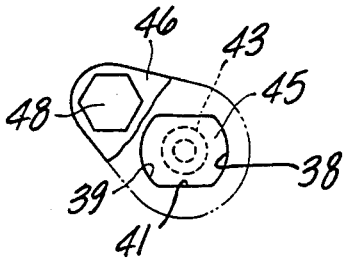
FIG. 3 is an enlarged view taken in the direction of the line 3—3 in FIG. 1.
Figure 2:
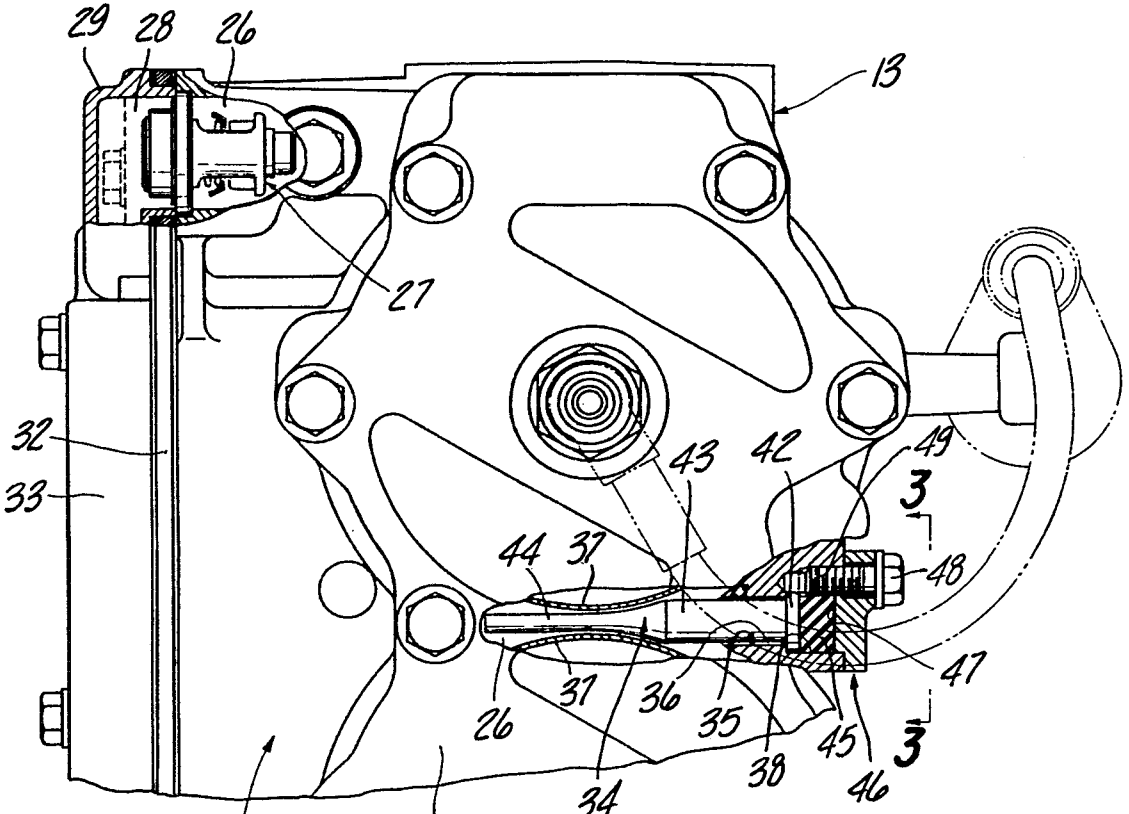
FIG. 2 is an enlarged view, with portions broken away, of the engine of the motor shown in FIG. 1.

Referring first primarily to FIG. 1, an outboard motor constructed in accordance with this invention is identified generally by the reference numeral 11. The motor 11 includes a power head, indicated generally by the reference numeral 12, which includes a water cooled internal combustion engine 13 and a surrounding protective cowling, which is shown in phantom and identified by the reference numeral 14. A drive shaft housing 15 depends from the power head 12 and rotatably supports a drive shaft 16 that is driven in a known manner from the output shaft of the engine 13. In this regard, it should be noted that the engine 13 is disposed so that its output shaft rotates about a generally vertically extending axis. A lower unit 17 is positioned beneath the drive shaft housing 15 and includes a forward, neutral, reverse transmission 18 via which a propeller shaft 19 is driven in a known manner. A propeller 21 affixed to the propeller shaft 19 is employed for powering an associated watercraft.

The outboard motor 11 is adapted to be affixed to this watercraft and specifically its transom for steering about a generally vertically extending axis and for tilting movement about a generally horizontally extending axis by means of a mounting assembly, indicated generally by the reference numeral 20 and which may be of the types normally used for these purposes.

Referring now to the remaining figures in addition to FIG. 1, the engine 13 includes a cylinder block 22 which, in the illustrated embodiment, supports a pair of cylinder bores, which are defined by cylinder liners as will be described, in which pistons reciprocate for driving the engine output shaft in a known manner. A cylinder head 23 is affixed to the cylinder block 22 in an appropriate manner. The cylinder block 22 and cylinder head 23 are formed with appropriate internal cooling jackets, which are shown only partially, and through which water from the body in which the associated watercraft is operating is drawn. This system includes a water pump 24 that is positioned within the drive shaft housing 15 and which is driven by the drive shaft 16 in a known manner. Water is drawn into the water pump 24 and discharged through a supply conduit 25 which extends upwardly through the drive shaft housing 15 and which terminates within the cooling jacket of the cylinder block 22, which cooling jacket is partially shown and is identified by the reference numeral 26. The upper portion of the cylinder block and specifically an upper portion of the cooling jacket 26 is provided with an outlet in which a thermostat 27 is provided. The thermostat 27 will open and close so as to permit circulation of coolant through the cylinder block cooling jacket 26 for maintaining an uniform temperature.

The thermostat 27, when opened, discharges into a chamber 28 formed by a closure plate 29 which communicates the coolant with a cooling jacket 31 of the cylinder head 23 in an appropriate manner. From the cylinder head jacket 31, coolant is returned to the body of water in which the motor 11 is operating in an appropriate manner.

The engine is also provided with an exhaust system which includes an inner exhaust plate 32 and an outer plate 33 which may between them define a further cooling jacket through which coolant is circulated so as to cool the exhaust system.

In accordance with the invention, a sacrificial anode assembly, indicated generally by the reference numeral 34 is supported in a specially configured opening, to be described and indicated generally by the reference numeral 35. The opening 35 extends from the cooling jacket 26 through one side face of the cylinder block 22 in an area beneath the cylinder head 13 and in an area where it is not obstructed by any other component of the engine. The opening 35 consists of a first cylindrical portion 36 that extends from the cooling jacket 26 in an area between two cylinder liners 37 of the cylinder block assembly. It is the liners 37 which form the cylinder bores in which the pistons are reciprocally supported. The cylindrical opening 36 terminates at a non-cylindrical opening 38 that is comprised of arcuate sections 39 joined by flat sections 41. The purpose of this configuration will become apparent.

The anode 34 may be formed from any suitable material normally used for this purpose such as magnesium or a magnesium alloy and has a first headed portion 42 that is complimentary in shape to the opening 38 and thus is non-rotatably supported within it. The headed portion is formed adjacent an integral, cylindrical part 43 that extends through the opening 35 with a slight clearance and which terminates within the cooling jacket 26 at a point adjacent the cylinder liners 37. From the cylindrical part 43, the anode 34 is provided with a reduced diameter, tapered section 44 that extends into and beyond the area between the adjacent surfaces of the cylinder liners 37 within the cooling jacket 26. Hence, a substantial portion of the cross-sectional area of the anode 34 is disposed in contact with the coolant in the cooling jacket 26.

Received within the specially formed opening 38 of the cylinder block 22 and in engagement with the anode headed portion 42 is an elastomeric seal 45 that has a configuration complimentary to that of the opening portion 38. This seal 45 and the anode 34 are held in place by means of a closure plate, indicated generally by the reference numeral 46. The closure plate 46 has a pilot portion which terminates in a surface 47 that engages and compresses the seal 45. The pilot portion 47 is also complimentary in shape to the opening 38 so that when the closure plate 46 is received within it, it will be held non-rotatably.

Because of this non-rotatable connection, it is possible to hold the closure plate 46 in place with a single bolt, indicated by the reference numeral 48 and which is threaded into a tapped opening 49 formed in the cylinder block 22 adjacent the specially formed opening 35. It should be readily apparent that because of this construction an operator or owner may conveniently insert and remove the sacrificial anode through the insertion and removal of only a single bolt 48 and the closure plate 46 which will give access to the seal 45 and the anode 34. Thus, the anode may be conveniently removed for inspection and reinserted. This can also be done without necessitating removal of any other component of the engine and the only service item that need be replaced is the simple seal 45 which can be low in cost.

It should be readily apparent from the foregoing description that a very effective, easily serviced and low cost sacrificial anode for the cooling system of a marine engine has been provided. Although an embodiment of the invention has been illustrated and described, various changes and modifications may be made without departing from the spirit and scope of the invention, as defined by the appended claims.

I claim:

1. In a cooling system for an internal combustion engine of a marine propulsion unit having a working chamber, a cooling jacket encircling at least in part said working chamber, the improvement comprising said engine having a component defining an external opening communicating with said cooling jacket, a sacrificial anode having a first part supported in said opening and a second part extending at least in part into said cooling jacket, closure means forming a sealed closure for said opening, and fastening means for affixing said closure means to said engine in sealing relationship with said opening, said connection between said closure means and said component defining the opening prevents rotation of said closure means independent of said fastening means.

2. In a cooling system as set forth in claim 1 wherein rotation of the closure means is precluded by a non-cylindrical portion of the opening and a complimentary interengaging non-cylindrical portion of the sacrificial anode.

3. In a cooling system as set forth in claim 2 wherein the closure means is affixed to the component by a single fastening means.

4. In a cooling system for an internal combustion engine of a marine propulsion unit having a cylinder block defining a pair of cylinder bores surrounded by a cooling jacket, the improvement comprising said engine having an external opening formed in said cylinder block and communicating with said cooling jacket, a sacrificial anode having a first part supported in said opening and a second part extending at least in part into said cylinder jacket into proximity with the cylinder bores, closure means forming a sealed closure for said opening, and fastening means for affixing said closure means in sealed relationship with said opening, said connection between said closure means and said component defining the opening prevents rotation of said closure means independent of said fastening means.

5. In a cooling system as set forth in claim 4 wherein rotation of the closure means is precluded by a non-cylindrical portion of the opening and a complimentary interengaging non-cylindrical portion of the sacrificial anode.

6. In a cooling system as set forth in claim 5 wherein the closure means is affixed to the component by a single fastening means.

* * * * *